US006367293B1

(12) United States Patent
Elliott

(10) Patent No.: US 6,367,293 B1
(45) Date of Patent: Apr. 9, 2002

(54) LOCK FOR THE PLUG OF A POWER CORD

(76) Inventor: Timothy J. Elliott, 105 Fair Lawn Ct., Stephens City, VA (US) 22655

( * ) Notice: Subject to any disclaimer, the term of this patent is extended or adjusted under 35 U.S.C. 154(b) by 0 days.

(21) Appl. No.: 09/731,864

(22) Filed: Dec. 8, 2000

(51) Int. Cl.[7] ..... E05B 65/00
(52) U.S. Cl. ..... 70/57; 439/133
(58) Field of Search ..... 70/57, 58, 63, 70/158–162, 14; 439/133–135, 304, 367

(56) References Cited

U.S. PATENT DOCUMENTS

| | | | | | |
|---|---|---|---|---|---|
| 2,643,787 | A | * | 6/1953 | Rockman | 70/57 X |
| 2,716,882 | A | * | 9/1955 | Gill et al. | 70/57 X |
| 2,955,272 | A | | 10/1960 | Gallardo | 439/134 |
| 3,126,243 | A | * | 3/1964 | Manetti et al. | 439/133 X |
| 3,180,473 | A | * | 4/1965 | Garvey | 70/57 X |
| 3,792,414 | A | | 2/1974 | Smith | 439/134 |
| 3,902,340 | A | * | 9/1975 | Leyden | 70/57 |
| 4,488,764 | A | * | 12/1984 | Pfenning et al. | 70/57 X |
| 4,593,541 | A | * | 6/1986 | Hollis | 70/57 |
| 4,676,569 | A | * | 6/1987 | Lambert et al. | 439/133 |
| 4,679,873 | A | | 7/1987 | Brackett, Jr. | 439/134 |
| 5,052,939 | A | * | 10/1991 | Koch | 439/133 |
| 5,073,122 | A | * | 12/1991 | Burke, Jr. | 439/134 |
| 5,097,103 | A | * | 3/1992 | Workman et al. | 439/133 X |
| 5,108,297 | A | * | 4/1992 | Hoffman et al. | 439/134 |
| 5,139,429 | A | * | 8/1992 | Herman et al. | 439/133 |
| 5,178,551 | A | * | 1/1993 | Bach | 439/133 |
| 5,186,636 | A | | 2/1993 | Boyer et al. | 439/134 |
| 5,277,599 | A | * | 1/1994 | Nilson | 439/133 |
| 5,573,412 | A | * | 11/1996 | Anthony | 439/133 |
| 5,601,440 | A | * | 2/1997 | Richter | 439/134 |
| 5,890,919 | A | * | 4/1999 | Geisler | 439/134 |
| 6,056,563 | A | | 5/2000 | Betzler | 439/134 |
| 6,149,445 | A | * | 11/2000 | Daddono | 439/133 |

* cited by examiner

*Primary Examiner*—Suzanne Dino Barrett
(74) *Attorney, Agent, or Firm*—Hoffman, Wasson & Gitler, PC

(57) ABSTRACT

The lock for the plug of a power cord has a housing in which the cord is retained. The top surface of the container has a tapered oval shape. A closure having a similar shape to the top surface of the container serves to close the container and has an aperture allowing the egress of the power cord. The closure is pivotally connected to the container by means of a hinge pin. The container and closure also has a pair of mating apertures allowing for the attachment of a locking mechanism.

13 Claims, 5 Drawing Sheets

LOCK FOR THE PLUG OF A POWER CORD

FIELD OF THE INVENTION

The invention is a device for securely locking the plug of a power cord to prevent the unauthorized use of the electrical device.

BACKGROUND OF THE INVENTION

Many people have the need to prevent the unauthorized use of an electrically powered device, such as an appliance, computer or power tool. One simple way to prevent the unauthorized use of a device, regardless of the nature of the device, is to prevent the plug from being inserted into an outlet. If the device cannot be connected to an outlet, the device cannot be used and the user has easily and simply prevented the unauthorized use of the device. Some reasons that people feel the need to prevent the use of an electrical device include computers having sensitive data or wishing to prevent others, particularly minors, from accessing the Internet. Also, a device preventing the unauthorized use of a power tool is a safety measure, if small children would be tempted to use the tools when they are not qualified to do so. Also, such a device can prevent the use of a television or VCR if parents do not want their children to use these appliances.

The prior art discloses several devices which lock the plug of a power cord within a container. Once locked, the plug cannot be inserted into an outlet, and the prevention of the unauthorized use of the device is accomplished. One such device is disclosed in U.S. Pat. No. 2,955,272 (Gallardo) . Gallardo discloses a container 12 having a bottom wall 14 and a top closure 18. An aperture 38 allows the egress of the power cord from the container. A lock 24 attached to the underside of the top closure secures the container and prevents the removal of the plug.

Another such prior art device is disclosed by Brackett, Jr., U.S. Pat. No. 4,679,873. Brackett, Jr. discloses an electrical plug lock having a container 16 with a bottom wall 34. A top closure 22 has an aperture 20 allowing for the egress of a power cord 12. The closure has an extension 14 extending the length of the cylindrical housing 16 and extending through aperture 36 in the bottom wall 34. A padlock extends through aperture 26 in the closure member 14 and prevents the removal of the closure. In this manner, the plug is secured within the cylindrical housing 16.

It is an object of the invention to provide a lock for a plug that is small and easy to use.

It is another object of the invention to provide a lock for a plug that is inexpensive to manufacture.

It is yet another object of the invention to provide a lock having a closure that is easy to manipulate between the open and closed positions.

It is another object of the invention to provide a lock for a plug that can be stored on the power cord when not in use.

It is still another object of the invention to provide a lock for a plug that securely retains a plug within a container.

These and other objects of the invention will be apparent to one of ordinary skill in the art after reviewing the description of the invention that follows.

SUMMARY OF THE INVENTION

The lock for the plug of a power cord has a housing retaining the power cord. The top surface of the container has a tapered oval shape. A closure having a similar shape to the top surface of the container serves to close the container and has an aperture allowing the egress of the power cord. The closure is pivotally connected to the container by means of a hinge pin. The container and closure also has a pair of mating apertures allowing for the attachment of a locking mechanism.

The container can be cylindrical and the top of the container is provided with a pair of diametrically opposed flanges. One of the flanges holds the hinge pin, while the other has an aperture for the lock. It is possible that the bottom of the container has a similar closure. If top and bottom closures are used, the container could have a cross-sectional shape similar to the shape of the two closures. This would obviate the need for flanges but allows for the hinge pins and lock to extend between the two closures and be hidden within the container. Not only is this aesthetically pleasing, but it prevents tampering with the hinge pin or locking mechanism.

BRIEF DESCRIPTION OF DRAWINGS

A description of the invention will be made with reference to the drawings of which.

DETAILED DESCRIPTION OF THE DRAWINGS

Figure 1:
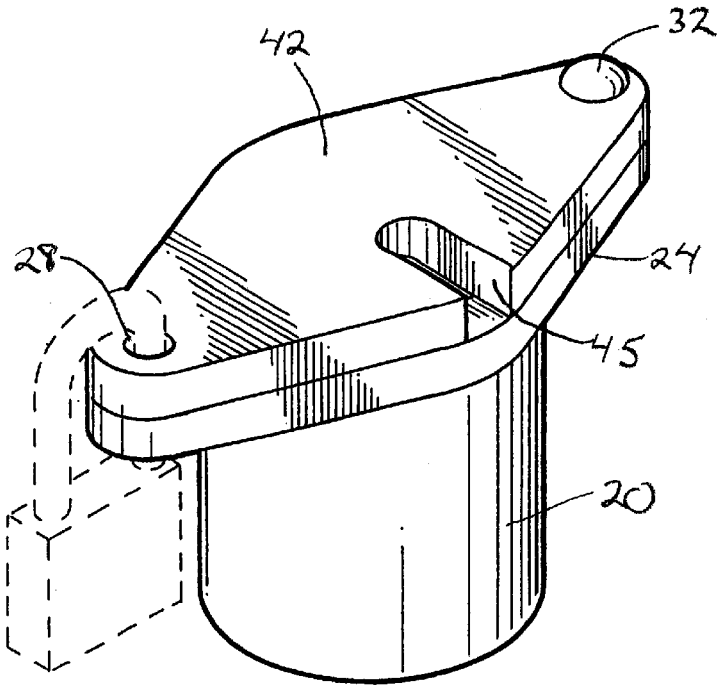
FIG. 1 is a perspective view of the device.

FIG. 1 shows a perspective view of the plug lock 10. The plug lock has a container 20 for retaining or storing a plug of a power cord. At the top end of the container portion is a first flange 24 and a second flange 28. The two flanges are diametrically opposed. Each flange has side edges which are tangent to the container 20 and have rounded ends.

Figure 2:
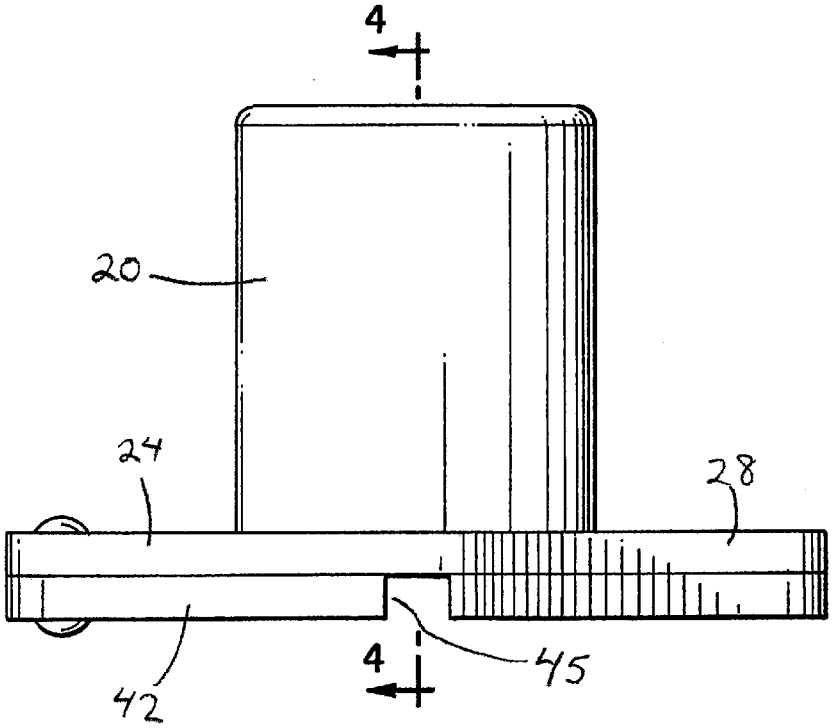
FIG. 2 is a side view of the device of FIG. 1.

As can be seen in FIG. 2, the closure 42 is attached to the container by a hinge pin 32. The hinge pin 32 extends through the first flange 24. A head on each end of the hinge pin retains it in place. An aperture 45 extends to the perimeter of the closure 42 and allows the power cord to extend out of the container when the plug is stored within the container.

Figure 3:
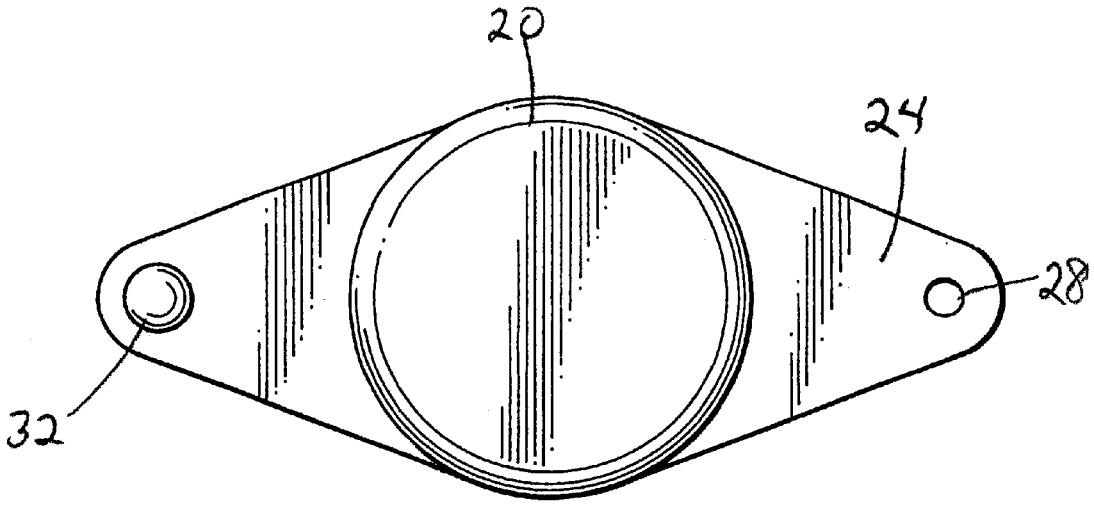
FIG. 3 is a bottom view of the device of FIG. 1.

FIG. 3 is a top view of the device and the closure can be readily seen. The closure 42 has a central portion which is circular and is the same size and shape of the container 20. It is this section that overlies and closes the container. A pair of flanges extend from the central portion and have edges that are tangent to the circular central portion. Each of the flanges has a rounded end. This shape is identical in size and shape to the top of the container 20 and is referred to as a tapered oval.

Figure 4:
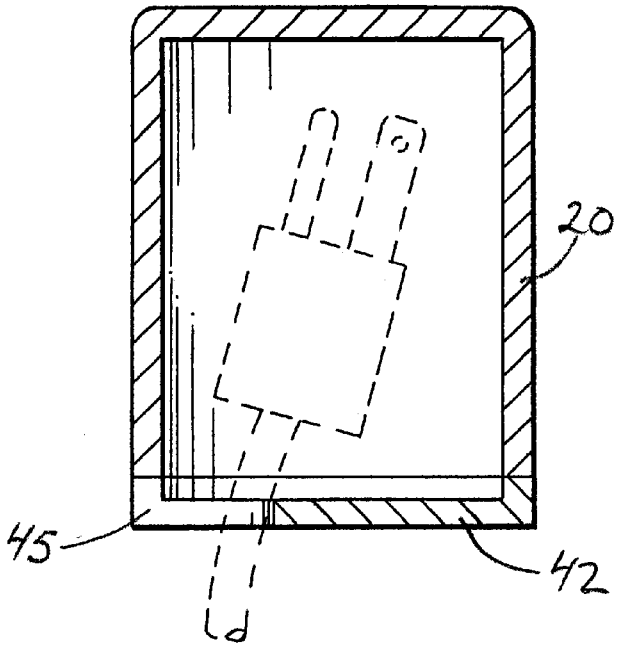
FIG. 4 is a cross-sectional view along lines 4—4 of FIG. 2 showing a plug in phantom.

A view of the device storing a plug is seen in the cross-sectional view of FIG. 4. In FIG. 4, the container 20 is closed by the closure 42. A plug, shown in phantom, is stored within the container 20. A cord extends out of the container 20 by extending through the aperture 45. The cord is placed within the aperture 45 by moving it from the perimeter of the closure into the aperture 45.

Figure 5:
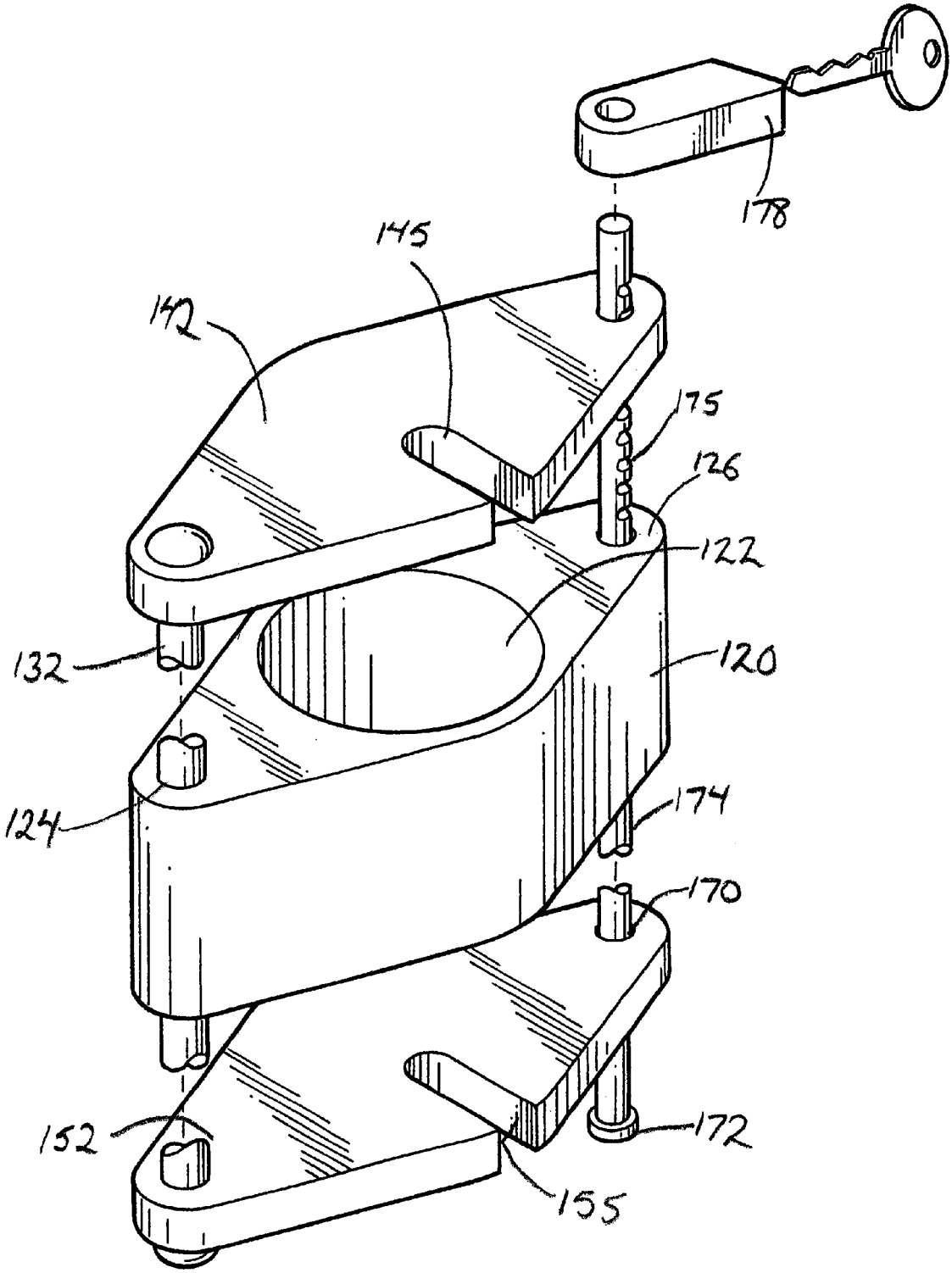
FIG. 5 is an exploded perspective view of a second embodiment of the invention.

An alternative embodiment is depicted in FIG. 5. The plug lock 110 has a container 120 having a central hole 122, a hinge pin hole 124 and a lock hole 126. As can be seen, the cross-sectional shape of the container is substantially identical to the shape of each of the top closure 142 and bottom closure 152. A hinge pin 132 extends through the top closure 142, bottom closure 152 and through the hinge pin hole 124. The hinge pin 132 has a pair of heads to retain the hinge pin in place. The hinge pin allows the pivoting motion of both closures. The top closure 142 has an aperture 145, and the bottom closure 152 has an aperture 155. A lock 170 retains the closures in their closed position. The lock 170 has a head 172 bearing against the bottom closure 152 and a shaft 174 extending through the bottom closure, the lock hole 126 and the top closure 142. The shaft 174 is provided with a plurality of notches 175. A barrel lock 178 attaches to and locks onto the shaft 174.

Figure 6:
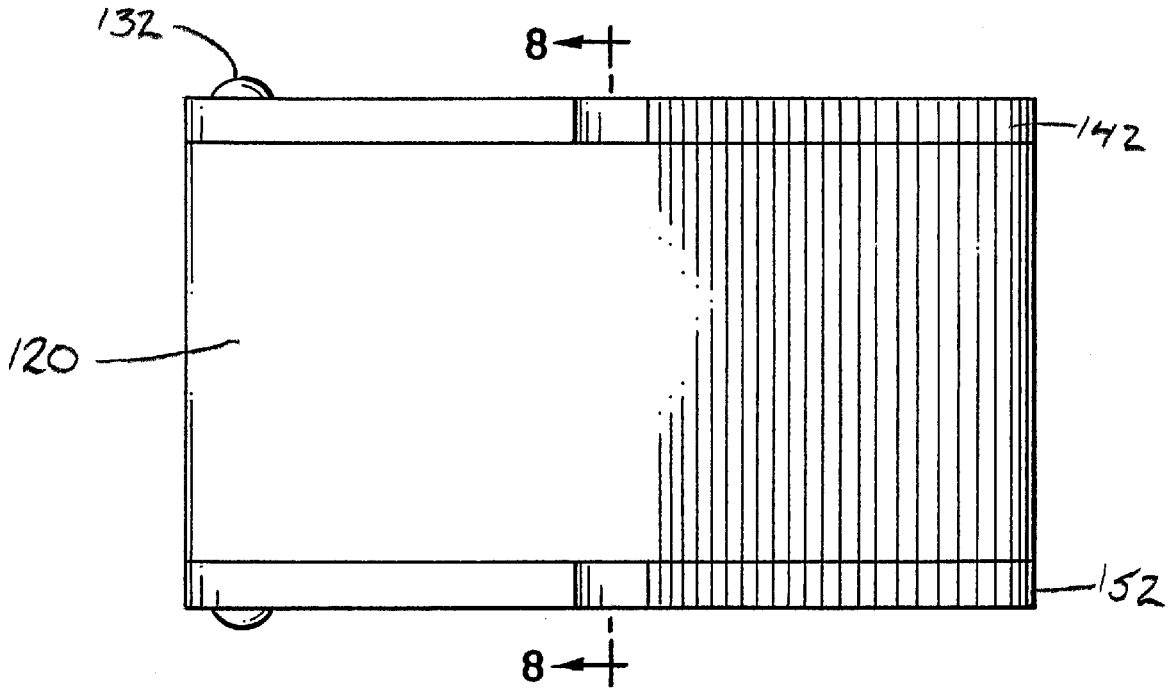
FIG. 6 is a side view of the second embodiment.

FIG. 6 shows a side view of the device. This view shows how the hinge pin and lock are not seen. As they extend through the container 120, they are hidden from view. This results in both a more aesthetically pleasing device and prevents tampering with the hinge pin 132 or lock 170. If the hinge pin or lock were tampered with by cutting or otherwise removing it from being retained to the closures and retainer, the device could be defeated. In this occurrence, the closures could be opened with removal of either the hinge pin or lock.

Figure 7:
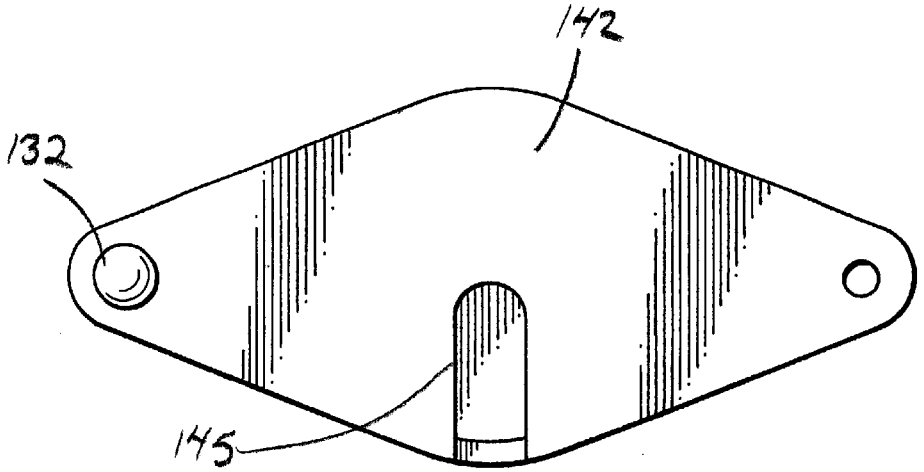
FIG. 7 is a top view of the embodiment of FIG. 5.

A top view of the device is depicted in FIG. 7. From the top view the hinge 132 and lock aperture can be seen in the top closure 122. The top view of the device is similar to the top view of the first embodiment.

Figure 8:
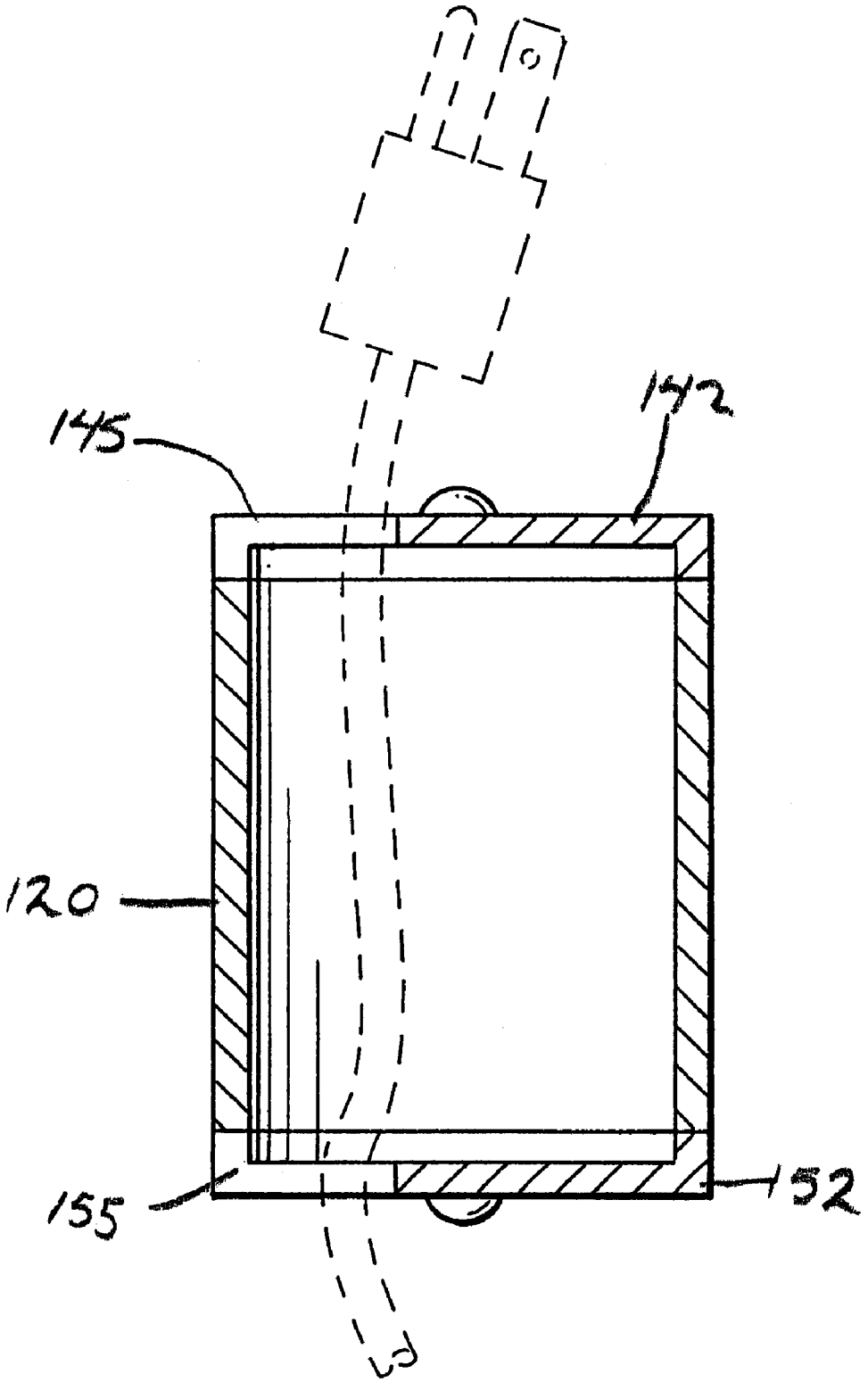
FIG. 8 is a cross-sectional view along lines 8—8 of FIG. 6.

Reference to FIG. 8 shows the use of the device. The cross-sectional view shows the container 120 with the passage of a power cord therethrough. This figure depicts the storage of the device on the power cord. The power cord extends through the bottom aperture 155, extends through the container 120 and then through the aperture 145. In the storage device, the plug can still be used by insertion into an outlet. This allows the convenient storage of the device when not in use. When in use, the closure can be opened, the plug can be placed within the container 120 and the closures locked in the closed position. The added benefit of the top and bottom closure each having an aperture for the passage of a power cord allows the device to be stored in a convenient location by simply allowing the passage of the power cord through the device and storing the device proximate the plug that will be retained to prevent unauthorized use.

While the device has been described with reference to preferred embodiments, many variations and modifications would be obvious to one of ordinary skill in the art without departing from the spirit of the invention. Such modifications and variations are within the scope of the invention that is defined by the appended claims.

What is claimed is:

1. A lock for a plug of a power cord, comprising a container for storing said plug, said container having at least one side wall, a top and a bottom end, said top end defining an opening, a flange extending from said container proximate said top end, said flange having an aperture, a top closure for closing said top end, said top closure having a first flange, said first flange having an aperture in registry with said aperture in said container first flange, a hinge pin extending through said aperture in said closure flange and said aperture in said container flange to allow relative pivoting movement between said container and said top closure, said top closure pivoting in a plane parallel to said container top end, an aperture in said top closure for allowing the egress of said power cord, said aperture extending to the perimeter of said top closure.

2. The lock of claim 1, further comprising a locking structure for locking the top closure to said container to prevent relative motion.

3. The lock of claim 2, wherein said locking structure comprises a second flange extending from said container, said container second flange having an aperture, a second flange extending from said closure, said closure second flange having an aperture, said aperture in said container second flange in registry with said aperture in said closure second flange for allowing the passage of a locking mechanism.

4. The lock of claim 3, wherein said locking mechanism is a padlock.

5. The lock of claim 3, wherein said second flange on said closure is diametrically opposed to said first flange on said closure.

6. The lock of claim 1, wherein said top closure has a tapered oval shape.

7. A lock for a plug of a power cord, comprising a container for storing said plug, said container having a first central aperture, for storing said plug, a second aperture for holding a hinge pin and a third aperture for holding a locking mechanism, said first, second and third apertures being substantially parallel, a top closure, said top closure covering the top of said first aperture and having a fourth aperture in registry with said second aperture and a fifth aperture in registry with said third aperture, said top closure having an egress aperture for allowing the passage of said power cord, said egress aperture extending to the perimeter of said top closure, a hinge pin extending through said second and fourth aperture.

8. The lock of claim 7, further comprising a bottom closure, said bottom closure covering the bottom of said first central aperture, said bottom closure having a sixth aperture in registry with said second aperture and a seventh aperture in registry with said third aperture, a top closure, said top closure covering the top of said first central aperture, said top closure having a sixth aperture in registry with said second aperture and a seventh aperture in registry with said third aperture, said hinge pin extending through said sixth aperture.

9. The lock of claim 8, further comprising a locking mechanism extending through said third aperture, said fifth aperture and said seventh aperture.

10. The lock of claim 8, wherein said top closure and said bottom closure have a tapered oval shape.

11. A lock for a plug of a power cord, comprising a container for storing said plug, said container having at least one sidewall, a top and a bottom, a top closure, said top closure having a shape substantially similar to the shape of a said container top surface, said top closure having an aperture for allowing the egress of said power cord, said aperture extending to the perimeter of said top closure, a hinge pin extending through said top closure and through said container top surface, a locking structure for locking said top closure to said container, a bottom closure, said bottom closure having a shape substantially similar to the shape of a said container bottom surface, said bottom closure having an aperture for allowing the egress of said power cord, said aperture extending to the perimeter of said bottom closure, said hinge pin extending through said bottom closure and through said container bottom surface.

12. The lock of claim 11, wherein said locking structure comprises an aperture in said top closure, an aperture in said container top surface and a locking mechanism extending through both apertures to prevent relative motion between said container and said top closure.

13. The lock of claim 11, wherein said top closure and said container top surface have a tapered oval shape.

* * * * *